US006588060B1

(12) United States Patent
Arentsen et al.

(10) Patent No.: US 6,588,060 B1
(45) Date of Patent: Jul. 8, 2003

(54) HINGED DRAPERY ROD

(75) Inventors: Anita Arentsen, 223 B. Cherokee Dr., Bolingbrook, IL (US) 60440; Robert Mrugala, Lockport, IL (US)

(73) Assignee: Anita Arentsen, Bolingbrook, IL (US)

( * ) Notice: Subject to any disclaimer, the term of this patent is extended or adjusted under 35 U.S.C. 154(b) by 0 days.

(21) Appl. No.: 09/961,455

(22) Filed: Sep. 24, 2001

Related U.S. Application Data

(63) Continuation-in-part of application No. 09/706,944, filed on Nov. 6, 2000, now Pat. No. 6,499,186.

(51) Int. Cl.[7] ..... A47H 13/00

(52) U.S. Cl. ..... 16/87 R; 211/105.1; 160/335; 248/264; 16/90

(58) Field of Search ..... 16/87 R, 87.4 R, 16/90, 90 D, 94 R; 211/105.1, 105.2, 123; 160/330, 352, 370.21, 333, 335, 90; 248/251, 255, 256, 260–265, 200.1; 49/70

(56) References Cited

U.S. PATENT DOCUMENTS

| | | | | | |
|---|---|---|---|---|---|
| 1,712,834 | A | * | 5/1929 | McClure | 248/256 |
| 3,079,005 | A | * | 2/1963 | Bednar | 211/96 |
| 3,946,978 | A | * | 3/1976 | Evans | 16/94 D |
| 4,117,557 | A | | 10/1978 | McPeak et al. | 4/149 |
| 4,179,091 | A | | 12/1979 | Bidney | 248/265 |
| 4,283,035 | A | | 8/1981 | Ojembarrena et al. | 248/263 |
| 4,322,050 | A | | 3/1982 | Roach | 248/222.2 |
| 4,662,596 | A | | 5/1987 | Haarer | 248/251 |
| 4,682,452 | A | | 7/1987 | Propp et al. | 52/118 |
| 4,767,013 | A | | 8/1988 | Bertelli | 211/96 |
| 4,796,312 | A | | 1/1989 | Corlew | 4/555 |
| 4,824,062 | A | | 4/1989 | Wagner | 248/265 |
| 5,011,030 | A | | 4/1991 | Alaurent | 211/105.6 |
| 5,018,626 | A | | 5/1991 | Johnson | 211/105.1 |
| 5,025,338 | A | | 6/1991 | Austin | 211/105.1 |
| 5,082,226 | A | | 1/1992 | Mahan | 248/265 |
| 5,263,594 | A | | 11/1993 | Bianchi | 211/105.2 |
| 5,348,414 | A | | 9/1994 | Dziuk et al. | 403/90 |
| 5,529,273 | A | | 6/1996 | Benthin | 248/254 |
| 5,564,666 | A | | 10/1996 | Pfeil | 248/263 |
| 5,641,143 | A | | 6/1997 | Garza et al. | 248/263 |
| 5,810,302 | A | | 9/1998 | McCance | 248/200.1 |
| 6,032,915 | A | | 3/2000 | Brindisi | 248/466 |

FOREIGN PATENT DOCUMENTS

| | | | |
|---|---|---|---|
| DE | 19950950 A1 | * | 11/2001 |
| EP | 0312186 | * | 4/1989 |
| FR | 2448329 | * | 10/1980 |
| JP | 2000-279316 A | * | 10/2000 |
| WO | WO 00/67623 | * | 11/2000 |

* cited by examiner

*Primary Examiner*—Chuck Y. Mah
(74) *Attorney, Agent, or Firm*—Ryndak & Suri

(57) ABSTRACT

A hinged drapery rod provides a continuous drapery mounting surface that extends across a two-panel door configuration wherein one door is stationary and the other door is operable, opening interiorly and hinged between the doors. The hinged drapery rod of the invention comprises a flexible, expandable bridging member extending between and attached to two directionally opposed elongated rods. The length of the flexible, expandable bridging member varies during opening and closing of the operating door. The drapery rod of the invention allows a continuous drapery to be mounted across the two-door configuration and also may be used on a single door/window combination where the door is hinged between the door and the window.

22 Claims, 7 Drawing Sheets

32a
35
33
12
48
7
28
50
38
52a
40
26'
52b
46
44
22
30
14
32b 32a
12
90
86
36
10
16
84
94
X
14
98
92
88
96
32b

HINGED DRAPERY ROD

RELATED APPLICATION

This application is a continuation-in-part of U.S. Ser. No. 09/706,944, filed Nov. 6, 2000 now U.S. Pat. No. 6,499,186, entitled Hinged Drapery Rod.

FIELD OF THE INVENTION

This invention relates to a drapery rod assembly, and in particular, to a hinged drapery rod and method for use on a pivotable two-panel surface such as a door.

BACKGROUND OF THE INVENTION

It is common practice to mount drapery, which typically hangs from a drapery rod, not only upon walls but also upon hinged panels (typically doors) that are openable. Such panels are frequently designed as a two-panel door configuration wherein one door is stationary (non-operating) and the other door is openable (operating) allowing egress into another interior room or to the exterior of a household. The operating door is hinged between the operating panel and the non-operating door. Typically, the exterior operating door opens to the interior of the building. This operating/non-operating two-panel configuration also can be used on cabinets, windows or varying combinations thereof, as desired.

A problem, however, arises when attempting to decorate these two-panel surfaces with draperies. Known techniques mount drapery separately upon each individual panel. This allows the pivoting door panel to open and close freely without the drapery interfering with the panel's pivot motion, provided sufficient clearance is present to allow the operating door to open inwardly without contacting the drapery or rod on the non-operating panel. Separately mounting drapery upon each individual door panel is not desirable because an unsightly gap is created in drapery coverage between the two door panels. This detracts from an otherwise uniform interior decor wherein all the other draped wall dressings maintain a continuous flow about the vertical surfaces they enhance. Consequently, conventional drapery rods are inadequate for use on operating/non-operating two-panel arrangements.

A need therefore exists for a drapery rod assembly that provides a continuous mounting surface for an operating/non-operating two-panel door configuration, particularly where the operating door opens inwardly. A need also exists for a drapery and rod combination that provides continuous and uniform drapery coverage between the operating and non-operating panels while simultaneously allowing the door panel to open inwardly and close without interference from the drapery.

SUMMARY OF THE INVENTION

In accordance with the present invention, a hinged drapery rod provides a continuous drapery mounting surface for a two door or panel configuration wherein one door or panel is stationary (non-operating) and the other door or panel is operating, openable interiorly and hinged between the doors. The drapery rod extends across the doors or panels and is comprised of a hinge, a first elongated rod assembly of variable length attached to the hinge and a second elongated rod attached to the hinge and extending in the opposite direction from the first elongated rod assembly. Alternatively, the hinged drapery rod may be used with a door/window combination where the door is hinged between the window.

In accordance with another embodiment of the invention, the first elongated rod assembly includes first and second elongated portions. The first elongated portion is slidably moveable or partially moveable within the second elongated portion wherein the second portion is attached to the hinge.

In accordance with a further embodiment of the invention, the second elongated rod can be of either fixed or variable length.

In accordance with another aspect of the invention, a spring maintains the variable length of the first elongated rod assembly or the variable length of the second elongated rod.

In accordance with another aspect of the invention, the second elongated rod is comprised of two sections that are slidably moveable with respect to each other.

In accordance with another aspect of the invention, the first elongated rod assembly and the second elongated rod each further comprise bearings to assist the sliding motion between rod components.

In accordance with another aspect of the invention, the cross-sectional shape of the first elongated rod assembly and the second elongated rod may be rectangular, square, triangular, circular or elliptical.

In accordance with another aspect of the invention, a drapery assembly provides a hinged drapery rod for extending across and for spanning at least portions of two door panels wherein one door panel is stationary and the other is openable inwardly and hinged between the panels. The drapery assembly includes a hinge, a first elongated rod assembly of variable length attached to the hinge and a second elongated rod attached to the hinge and extending in the opposite direction from the first elongated rod assembly. A uniform length of drapery suitably adapted continuously covers the hinge, the elongated rod assembly and the second elongated rod throughout the operating door's entire range of motion.

Another aspect of the present invention provides a method for making a drapery rod to span across two door panels wherein one door panel is stationary and the other door panel is openable inwardly and hinged between the panels comprising the steps of providing a hinged drapery rod composed of a hinge, a first elongated rod assembly extending from the hinge of variable length, and a second elongated rod extending from the hinge opposed to the first elongated rod assembly; attaching the first elongated rod assembly and the second elongated rod to a hinge wherein the second elongated rod extends in an opposite direction from the first elongated rod assembly; and securing the first elongated rod assembly to the first door panel and securing the second elongated rod to the second door panel.

In accordance with still another aspect of the invention, a method is provided for spanning a continuous drapery across two door panels wherein one door panel is non-operating and the other is operating, opening inwardly and hinged between the two panels, comprising the steps of providing a hinged drapery rod composed of a hinge, a first elongated rod assembly of variable length extending from the hinge, and a second elongated rod extending from the hinge opposed to the first elongated rod assembly; securing the first elongated rod assembly to extend along at least a portion of the first door panel and securing the second elongated rod to extend along at least a portion of the second door panel with the hinged rod; providing a length of drapery suitably adapted to continuously cover the hinge, and at least portions of the first elongated assembly and second elongated rod assembly so that the drapery presents a continuous uniform appearance without a break.

In accordance with another aspect of the invention, a drapery rod assembly is provided having two horizontally spaced apart rod members with a flexible, expandable bridging member bridging the space between the two rod members. The flexible, expandable bridging member extends between and attaches to the opposed ends of the two spaced apart rods. The flexible, expandable bridging member operates in conjunction with the operating door panel by decreasing in length and bending when the operating door panel is opened. Correspondingly, the bridging member straightens and extends in length as the operating door panel closes. The flexible, expandable bridging member thereby provides a uniform continuous length to permit hanging of a continuous drapery throughout the entire range of motion for the operating door panel and which spans the distance between the two spaced apart rod members. Mounting a drapery upon the drapery rod having this flexible, expandable bridging member results in the ability to have continuous drapery coverage across the entire drapery rod assembly which spans the operating and non-operating panels, with no break in drapery coverage between the panels throughout the entire normal range of motion of the operating panel.

DETAILED DESCRIPTION OF THE PREFERRED EMBODIMENTS

Figure 1:
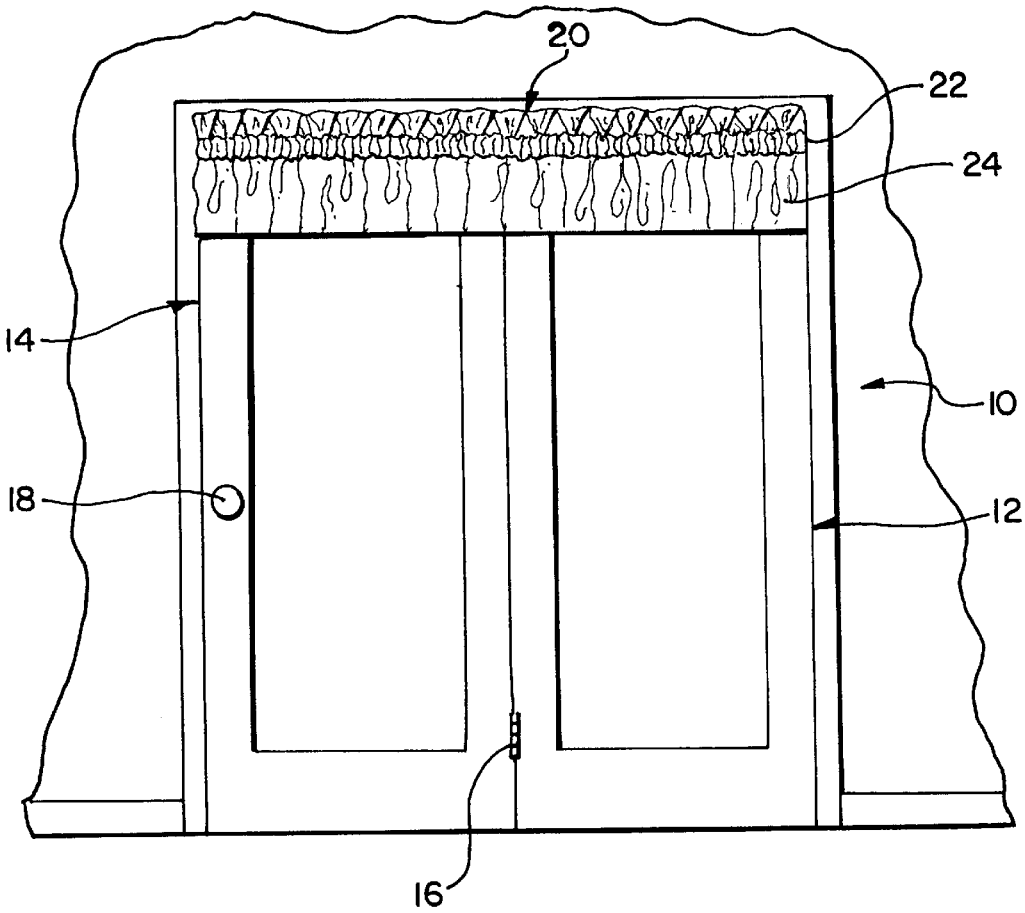
FIG. 1 is a front elevation view illustrating a drapery assembly in accordance with the invention mounted above a two-panel door wherein one door panel is stationary and the other door panel is openable.

Referring to the Figures generally, where like reference numerals denote like structure and elements, and in particular to FIG. 1, a two-panel door assembly 10 is depicted with a stationary or non-operating door 12 (which alternatively could be a window) and an operating door 14. Conventional door hinges 16, located between doors 12 and 14, enable operating door 14 to open inwardly, such as when pulling on door handle 18.

Although doors 12 and 14 are shown in the same vertical plane, it is to be understood that doors 12 (or a window) and 14 could be in different vertical planes, such as, for example, part of a bay door or window arrangement. Door 12 (or a window) could be laterally spaced from door 14 if desired as long as drapery assembly 20 is of sufficient length to span the desired length.

A drapery assembly 20 spans across the top portion of door assembly 10 including between doors 12 and 14. Drapery assembly 20 comprises a drapery rod 22, which will be described in detail below, that is mounted on door assembly 10 and a drapery 24. The term drapery is intended to encompass any fabric or other material hung for aesthetic or functional purposes as is known to those skilled in the art, including but not limited to curtains, drapes and valances. FIG. 1 depicts drapery 24 in continuous and uniform coverage of drapery rod 22 including between doors 12 and 14. In one aspect of the invention, drapery 24 is suitably adapted to provide continuous coverage of drapery rod 22 as operating door 14 opens and closes and through the entire practical range of motion of door 14.

Figure 2:
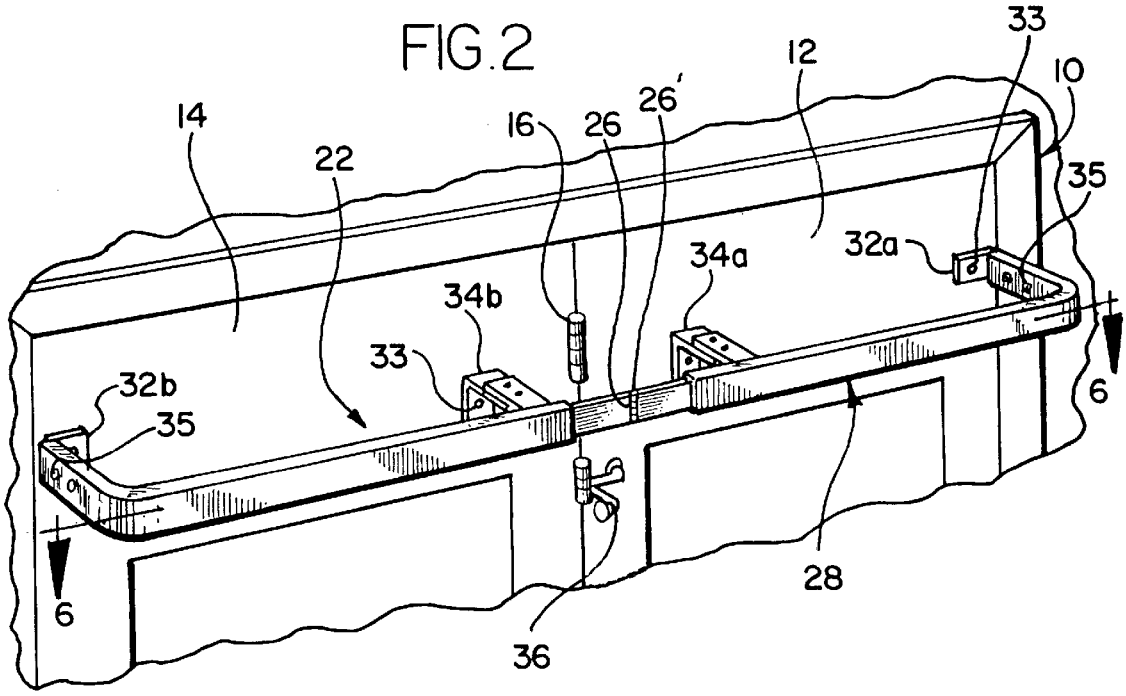
FIG. 2 illustrates a perspective view of a hinged drapery rod in accordance with the invention mounted on a two-panel door assembly.

FIG. 2 illustrates drapery rod 22 mounted across the top of two-panel door assembly 10 when operating door 14 is in the closed position. Drapery rod 22 comprises a hinge 26, a first elongated rod assembly 28, and a second elongated rod 30. Elongated rod assembly 28 and second elongated rod 30 are attached at hinge 26 and extend in opposed directions to span across both door panels 12 and 14. The length of elongated rod assembly 28 can span across an entire door panel, portions of both door panels or only a portion of one door panel, as desired. Elongated rod assembly 28 can also span an entire door panel, extend beyond the door trim and mount onto a wall surface. Drapery rod 22 extends continuously between doors 12 and 14 and likewise can span across, onto or over the door trim onto a wall surface.

As illustrated, hinge 26 is a piano-type hinge. Hinge 26 includes a centrally disposed pin 26'. It is to be understood that hinge 26 can be of any suitable construction and should have sufficient strength to withstand repeated operation over long periods of use.

Both elongated rod assembly 28 and second elongated rod 30 have mounting ends 32*a* and 32*b* enabling drapery rod 22 to be secured to a door panel or wall. At least one screw 33 secures mounting end 32*a* to door 12. At least one screw 33 likewise secures mounting end 32*b* to door 14. A plurality of bolts 35 attach drapery rod 22 to mounting ends 32*a* and 32*b*. Support brackets 34*a* and 34*b* may be installed to provide more stability for drapery rod 22 particularly near the hinge 26. Additional support brackets 34*a* and 34*b* may be installed on doors 12 and 14 when either drapery rod 22 or elongated rod assembly 28 is mounted upon a wall surface. Screws 33 also secure brackets 34*a* and 34*b* to two-panel door assembly 10. The distance between drapery rod 22 and door assembly 10 can be narrowed or widened by adjusting brackets 34*a* and 34*b*. Correspondingly, bolts 35 enable mounting ends 32*a* and 32*b* to be lengthened or shortened.

Figure 3:
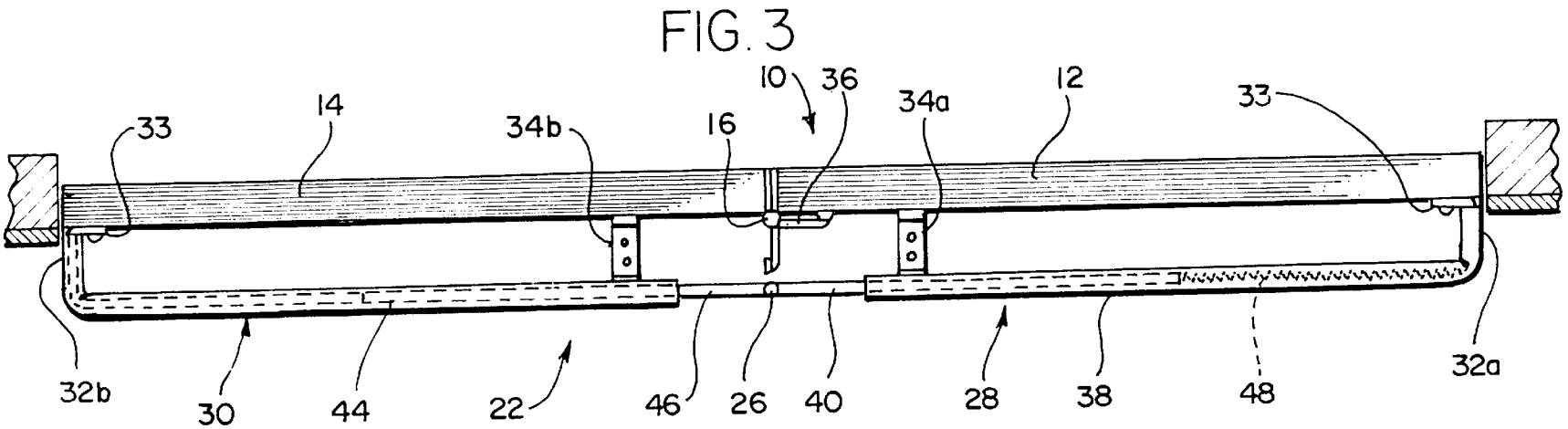
FIG. 3 is a top plan view of the hinged drapery rod of FIG. 2 in its fully extended configuration.
Figure 4:
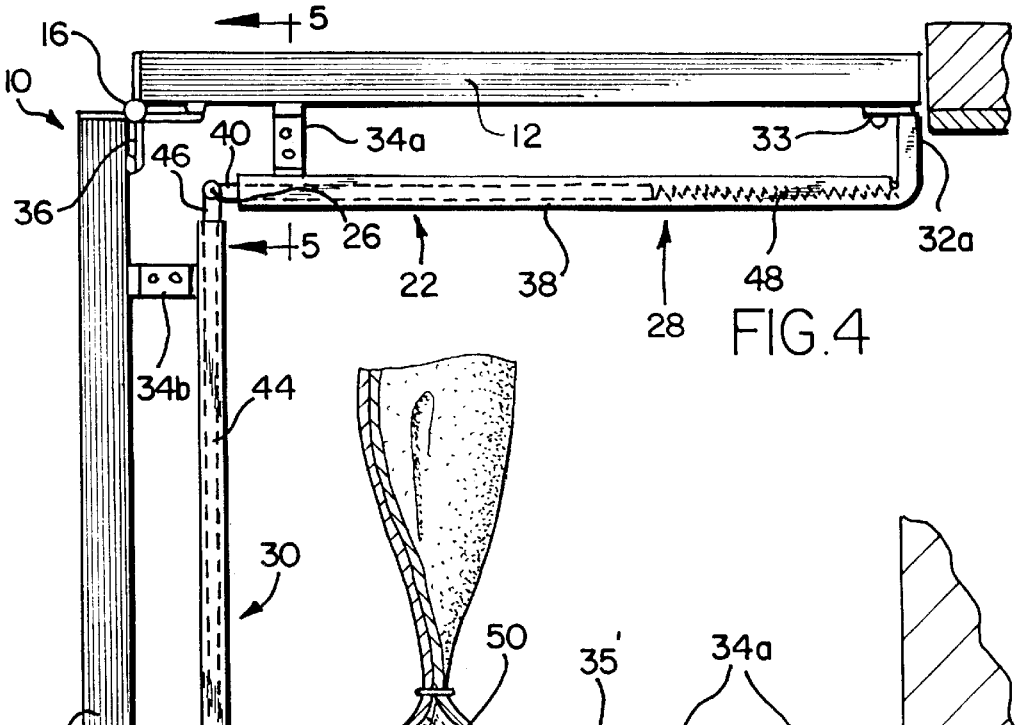
FIG. 4 is a top plan view of the hinged drapery rod of FIG. 2 when the door panel assembly is opened.

FIGS. 3 and 4 illustrate the varying lengths of drapery rod 22 as operating door 14 of two-panel door assembly 10 opens. In FIG. 3, elongated rod assembly 28 and elongated rod 30 are fully extended while operating door 14 is in a closed position. As operating door 14 opens, the length of elongated rod assembly 28 shortens. Rod assembly 28 and elongated rod 30 shorten to its shortest length when operating door 14 is fully opened. Door stopper 36 can be set at any desired angle to prevent operating door 14 from over extending.

In a preferred embodiment, elongated rod assembly 28 comprises first hollow elongated portion 38 and second elongated portion 40 disposed and slidable within hollow portion 38. First and second portions 38 and 40 slidably move with respect to each other shortening the length of elongated rod assembly 28 when operating door 14 opens inwardly as shown in FIG. 4 and lengthening when operating door 14 is closed. Any other suitable arrangement that permits assembly 28 to be of adjustable length to enable drapery rod 22 to shorten as operating door 14 opens and lengthen as operating door 14 closes can be used. For example, elongated rod assembly 28 could be constructed of elongated elements that slide externally alongside each other, above and below each other, in a rail arrangement, or sliding telescopically with second portion 40 sliding within first portion 38.

Elongated rod 30 can be of construction similar to elongated rod assembly 28 and as illustrated includes an outer hollow elongated rod section 44 and an inner elongated rod section 46, a portion of which is disposed within outer elongated rod 44. Alternatively, elongated rod 30 can be of fixed length or vice versa depending on door swing.

In one embodiment of the invention, a compression spring 48 optionally is provided between first elongated portion 38 and second elongated portion 40. Spring 48 provides tension within elongated rod assembly 28 enhancing the ability of second elongated portion 40 to return to its extended position once door 14 is closed after being opened. Spring 48 tends to urge second elongated portion 40 in a longitudinal direction away from first hollow elongated portion 38. Spring 48 thereby provides smoother operation of the shortening/lengthening motion of rod assembly 28 during operation of door 14. Similarly, it is also possible to place a compression spring between outer and inner elongated rod sections 44 and 46. It is to be understood that a compression spring need not be utilized when either elongated rod assembly 28 or second elongated rod 30 are of variable length.

Figure 5:
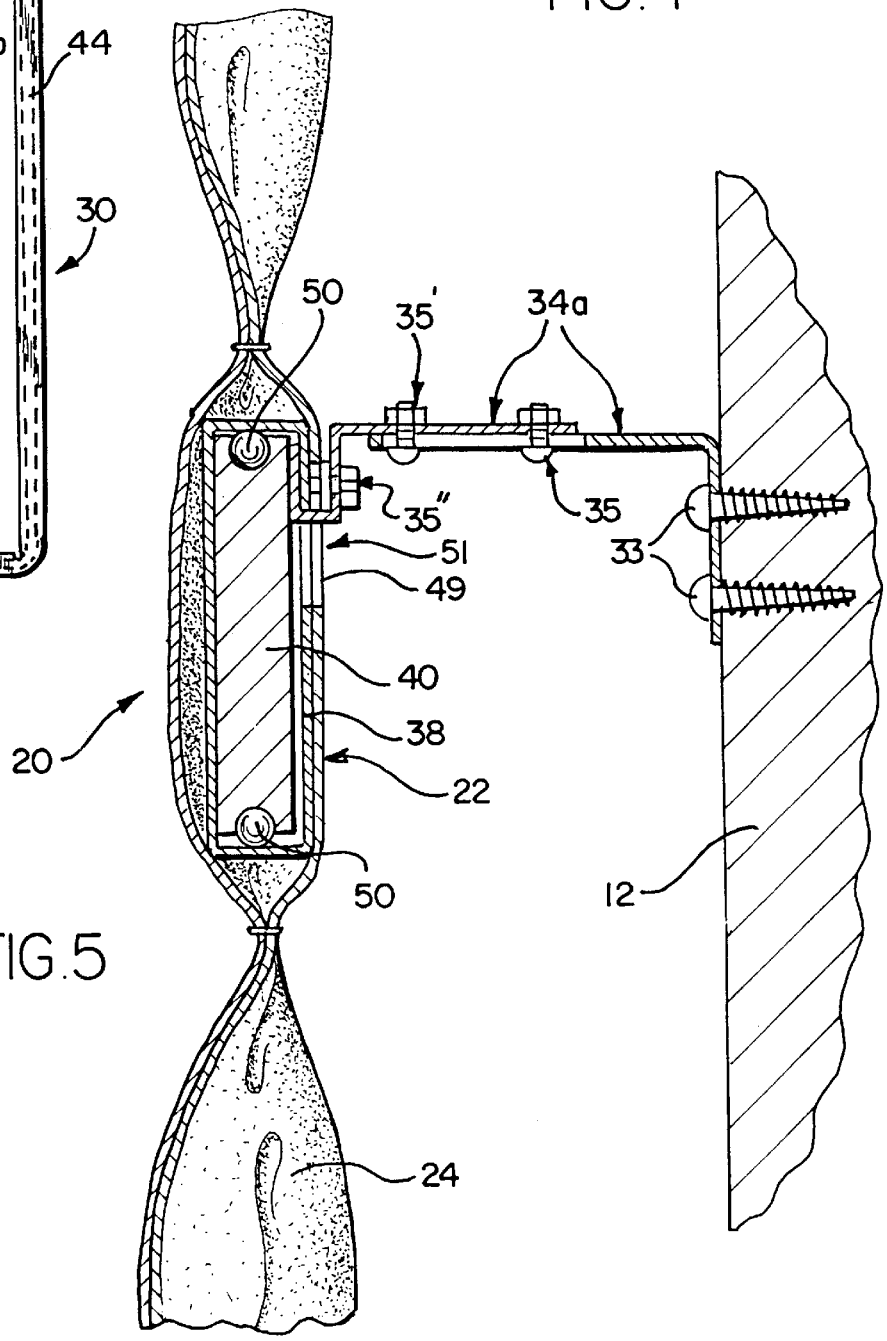
FIG. 5 is a cross-sectional view of the drapery rod along line 5—5 of FIG. 4.

FIG. 5 depicts a cross-sectional view of drapery assembly 20. As is known in the art, shirred rod pocket drapery has open ends and a sewn sleeve to slide drapery 24 onto drapery rod 22. Once drapery 24 is uniformly distributed upon drapery rod 22, a small slit 49 is cut in drapery 24 creating drapery pocket 51. This enables drapery 24 to accommodate mounting ends 32*a* and 32*b* as well as brackets 34*a* and 34*b*. First hollow elongated portion 38 and outer hollow elongated rod section 44 can be adapted with notches (not shown) that extend through drapery pocket 51 providing attachment means, such as a hook, for support brackets 34*a* and 34*b*. Suitable nuts and bolts 35 and 35' or other suitable fasteners as desired can be used to secure together bracket 34*a* and nut and bolt 35" or other suitable fastener or connecting structure as desired, which could be integral to some portion of drapery rod 22. The notches can be located on opposed top and bottom edges so that the portion 38 and section 44 can be reversed (either side up), if desired. Slit 49 and corresponding pocket 51 enable drapery 24 to provide continuous coverage of drapery rod 22 as door 14 opens and closes.

Figures 6, 7:
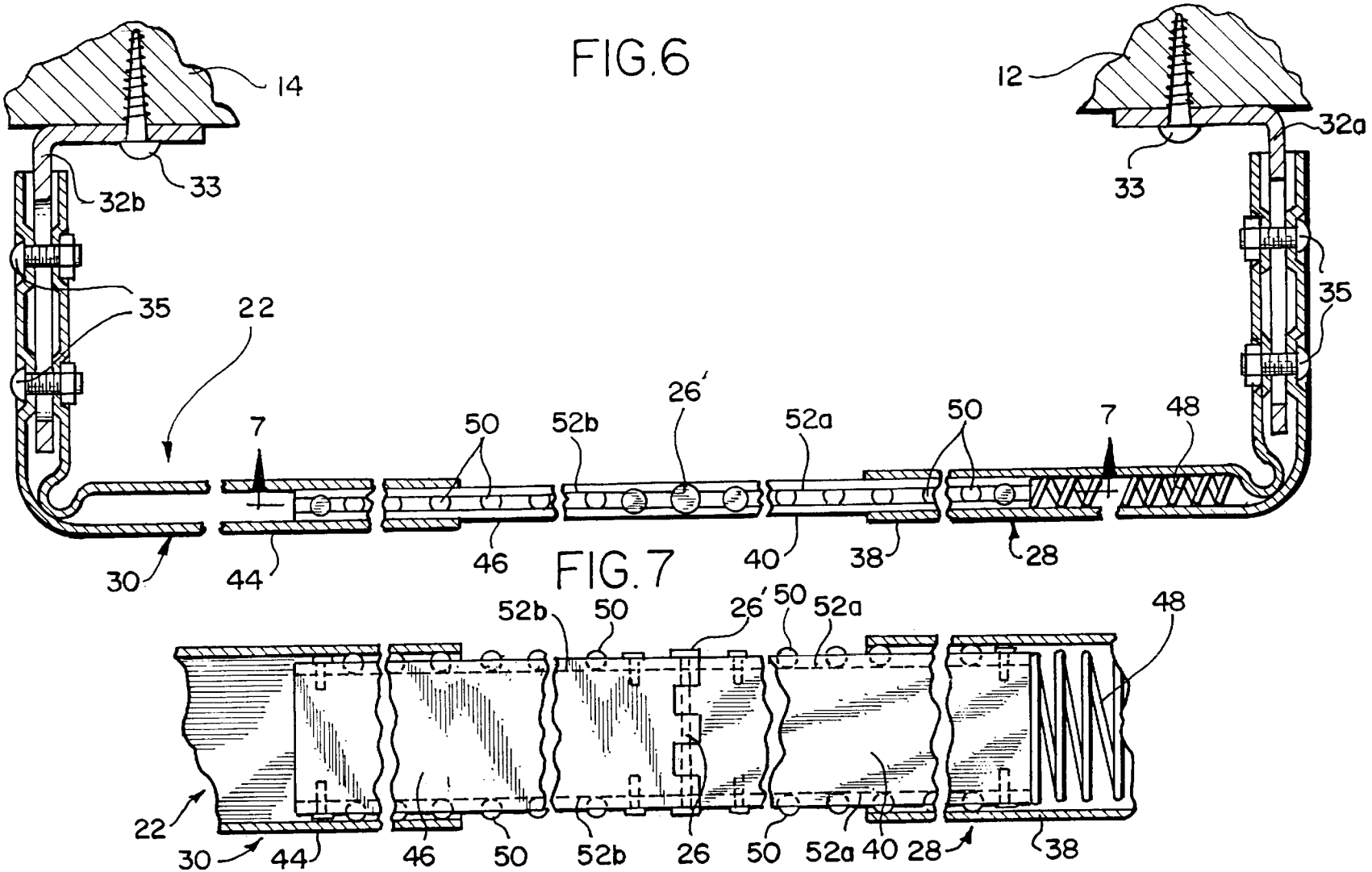
FIG. 6 is a cross-sectional view of the drapery rod along line 6—6 of FIG. 2.
FIG. 7 is a cross-sectional side elevation view of the drapery rod along line 7—7 of FIG. 6.

As illustrated in FIGS. 5–7, the cross-sectional shape of drapery rod 22 is rectangular. Optionally, structure is provided for facilitating sliding movement of the members of the variable length rod assembly. In the illustrated embodiment, bearings 50 between the inner surface of first elongated portion 38 and the outer surface of second elongated portion 40 facilitate the sliding motion between portions 38 and 40. Additionally, bearings 50 are located between the inner surface of outer section 44 and the outer surface of inner section 46. Bearings 50 stay in place preferably by enclosing them in a runner rail 52*a* along the top and bottom outer surfaces of second elongated portion 40. Likewise, runner rail 52*b* keeps bearings 50 in place along the top and bottom outer surfaces for second section 46. Bearing runner rails 52*a* and 52*b* are further illustrated by the dotted lines in FIG. 7. Runner rails 52*a* and 52*b* expose a portion of bearings 50 enabling bearings 50 to engage the inner surface of first elongated portion 38 and first section 44 thereby reducing friction between portions 38 and 40 and sections 44 and 46, respectively, during sliding motion.

Figure 8:
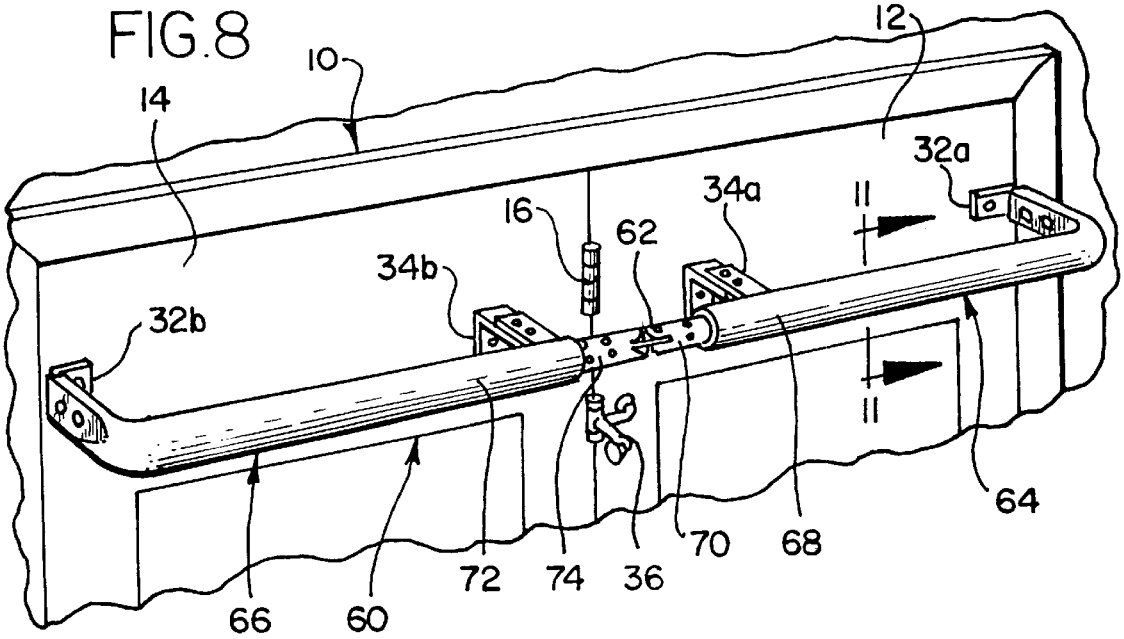
FIG. 8 is a perspective view of another embodiment of a drapery rod in accordance with the present invention.
Figure 9:
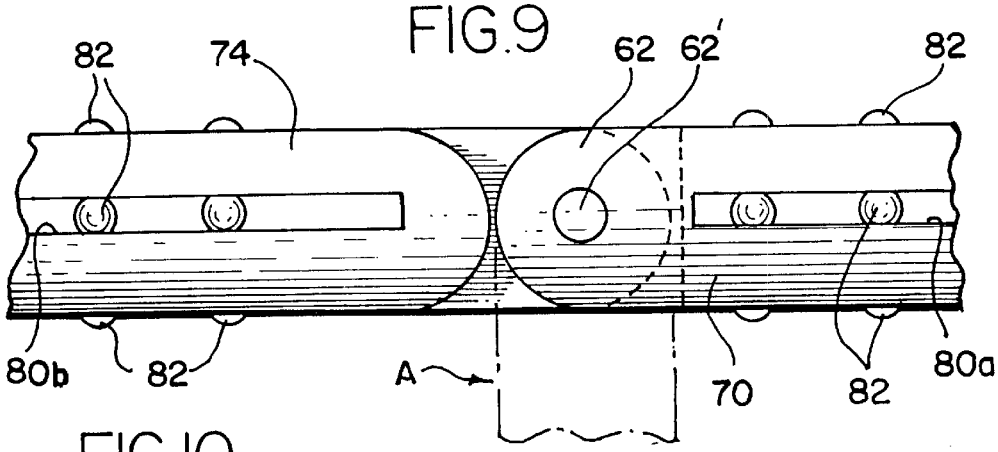
FIG. 9 is a plan view of a portion of the drapery rod of FIG. 8.
Figure 10:
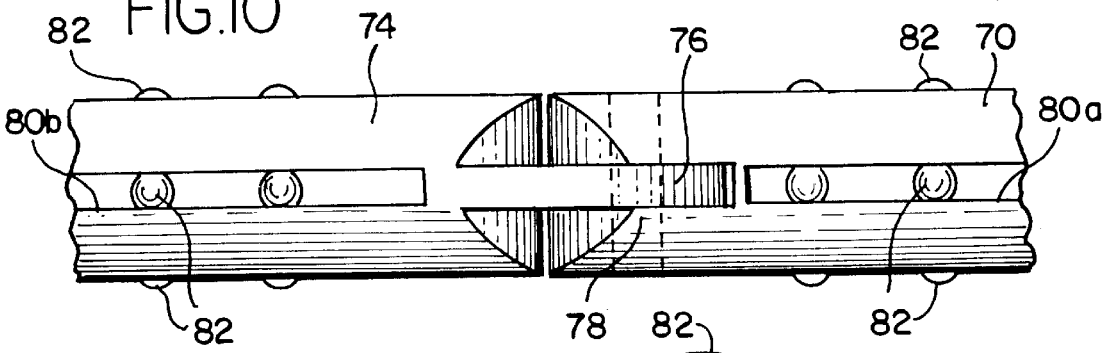
FIG. 10 is a side elevation view of a portion of the drapery rod of FIG. 8.
Figure 11:
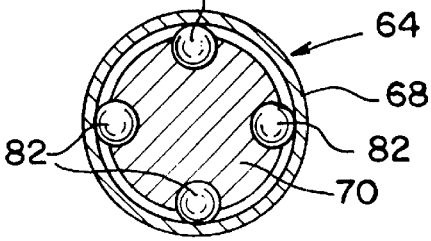
FIG. 11 is a cross-sectional view along line 11—11 of FIG. 8.

FIGS. 8–11 depict another embodiment of the invention wherein the cross-sectional shape of drapery rod 60 is circular. The configuration of circular hinge 62 is tailored for pivotal motion between circular elongated rod assembly 64 and circular second elongated rod 66 and as illustrated in FIG. 8, each rod assembly 64 and 66 is composed of an outer elongated circular rod 68 and 72 and an inner elongated circular rod section 70 and 74, respectively. Male hinge element 76 extends from inner elongated circular rod section 74 into female hinge element 78 thereby forming circular hinge 62. A hinge pin 62' connects together male and female hinge elements 76 and 78, respectively. Shadow lines A of FIG. 9 denote the position of inner elongated circular rod section 74 when door 14 is fully open. Arcuate runner rails 80a hold bearings 82 at right angles along the outer circumference of second elongated circular portion 70 as shown in FIGS. 9–11. Arcuate runner rails 80*b* similarly hold bearings 82 at right angles along the outer circumference of inner elongated circular rod section 74 as shown in FIGS. 9–10. Other cross-sectional shapes can be utilized, such as square, rectangular, oval, triangular or elliptical, for example. The various components of the drapery rod in accordance with the invention can be constructed of any suitable material as will be known in the art.

Although FIGS. 2–11 depict elongated drapery rod assembly 28 mounted on stationary door 12, it is equally possible to mount rod 28 onto operating door 14 and second elongated rod 30 onto stationary door 12 in the event egress occurs through door 12. Similarly, drapery assembly 20 could be mounted across a single door/window combination where the door is hinged between the door and the window.

Figures 12, 13:
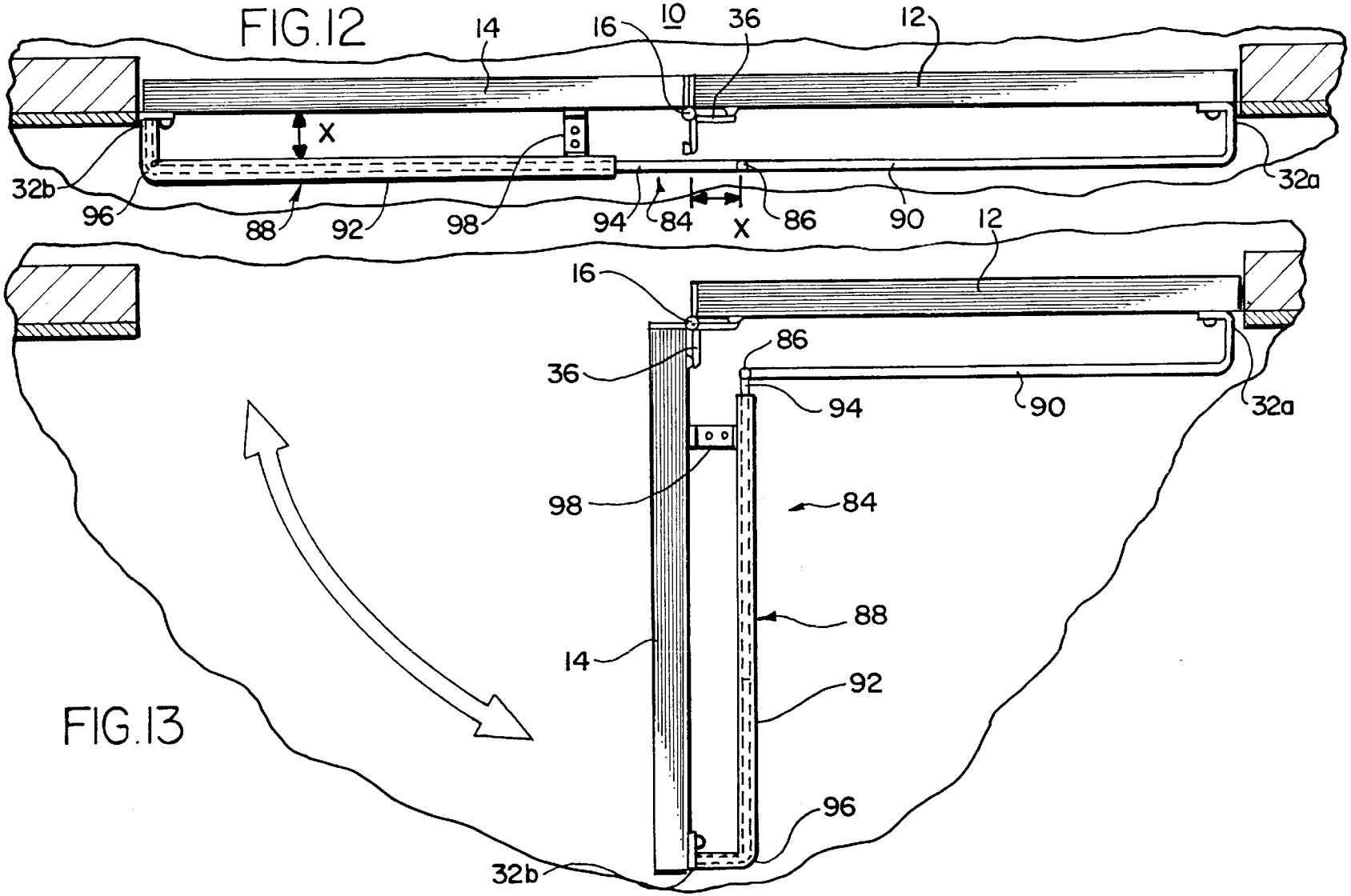
FIG. 12 is a top plan view of another embodiment of a hinged drapery rod in accordance with the invention.
FIG. 13 is a top plan view of the drapery rod of FIG. 12 when the door panel assembly is opened.

Another embodiment is illustrated in FIGS. 12–13. Drapery rod 84 includes a hinge 86, a first elongated rod assembly 88 of adjustable length and a second elongated rod 90 of fixed length. First elongated rod 88 extends from hinge 86 and second elongated rod 90 extends from hinge 86 opposed from rod 88. Hinge 86 is offset from the center of door panels 12 and 14 as illustrated in FIG. 12 to permit clearance from door 14 when opened, as illustrated in FIG. 13.

Elongated rod assembly 88 includes an outer elongated rod 92 and an inner elongated rod 94, similar to the construction of elongated rod assembly 28, previously described. As door 14 is opened, inner elongated rod 94 slides within outer elongated rod 92, thereby appropriately shortening the length of elongated rod assembly 88 to accommodate for the shorter length that is required for drapery rod 84. Hinge 86 is offset sufficiently to allow clearance with door 14. Distance X in FIG. 12 is the length between first elongated rod assembly 88 and door 14. Hinge 86 preferably is laterally offset up to a maximum distance X from door hinge 16 in the direction of door 12. The offset distance allows sufficient clearance distance between door 14 and elongated rod assembly 88 such that door 14 can open, preferably at least 90°. Alternatively, elongated rod assembly 88 is attached to door 14 by pivot structure 96 and floating bracket 98. As door 14 opens, pivot structure 96 and floating bracket 98 allow first elongated rod assembly 88 to move laterally with respect to floating bracket 98. This configuration also enables door 14 to open at least 90°. A second floating or stationary bracket (not shown) may also be used in connection with second elongated rod 90, typically in the region relatively close to the hinge 86 as opposed to being relatively close to the other end of rod 90. A spring and bearings or other structure (not shown) to facilitate sliding movement between outer elongated rod 92 and inner elongated rod 94 may be included as previously described with respect to elongated rod assembly 28.

Figure 14:
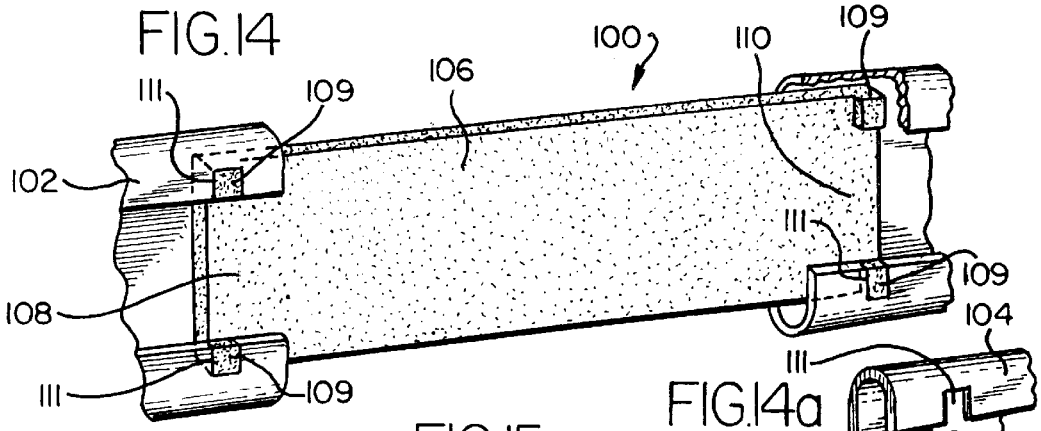
FIG. 14 is a side view of another embodiment of the hinged drapery rod in accordance with the present invention.
Figure 14A:
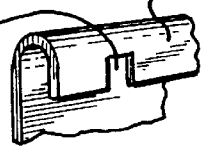
FIG. 14*a* is a fragmentary view of the end portion of an elongated rod from FIG. 14.

Other embodiments of the present invention are shown in FIGS. 14–17. Referring to FIGS. 14 and 14*a*, drapery rod assembly 100 comprises first elongated rod 102, second elongated rod 104 and flexible, expandable bridging member 106 as shown in FIG. 14. Rods 102 and 104 are of fixed length and span across door panels (not shown) in opposing directions as previously described. Rod 102 is secured to one panel while rod 104 is secured to the other panel. As shown in FIG. 14, bridging member 106 is an elastic rubber strip or strap having first and second end portions 108 and 110 which are attached to first and second rods 102 and 104 respectively. As illustrated, end portions 108 and 110 may comprise protrusions 109. Preferably, protrusions 109 are made of the same expandable material as flexible bridging member 106. The ends of rods 102 and 104 are provided with notches 111 as shown in FIG. 14*a*. Protrusions 109 are then inserted into corresponding notches 111 which are dimensioned to securely retain respective protrusions 109. Any suitable protrusion/slot shape or design can be utilized as desired. For example, protrusion 109 may further comprise an ear or expanded portion (not shown) at the end of protrusion 109. Preferably, the ear is wider than the width of notch 111. Once protrusion 109 is inserted into notch 111, the ear extends behind notch 111 to prevent protrusion 109 from sliding out of notch 111. Any suitable means to attach bridging member 106 to rods 102 and 104 can be utilized including adhesively bonding end portions 108, 110 to rods 102, 104; screwing, bolting, hooking or riveting end portions 108, 110 to rods 102, 104; or crimping or clasping the ends of rods 102, 104 onto end portions 108, 110.

Flexible, expandable bridging member 106 acts as a hinge and operates in unison with the opening and closing of the operating panel, typically a door, as previously described. As the operating panel opens, flexible bridging member 106 shortens (because typically member 106 has no slack when the operating panel is closed) and bends. Flexible bridging member 106 correspondingly increases in length and straightens as the operating panel closes. Drapery rod 100 is at its greatest length when the operating panel is closed and flexible bridging member 106 is fully extended.

Flexible bridging member 106 may be any flexible material that provides a continuous structure spanning the distance between the operating and non-operating panels allowing a continuous drapery to span the two panels and hang from the structure. Mounting a drapery on drapery rod 100 thereby results in continuous drapery coverage across the operating and non-operating panel with no break in coverage throughout the entire range of motion of the operating panel. Preferably, flexible bridging member 106 is made of a resilient material capable of enduring repeated bending and stretching as well as increasing and decreasing in length (i.e., when the operating panel is a door located in a high traffic area). Suitable materials for flexible bridging member 106 may include, but are not limited to, rubber, synthetic polymers, plastic, metal mesh or fabric, braided metal, or a textile product such as cloth or a synthetic fabric.

Figure 15:
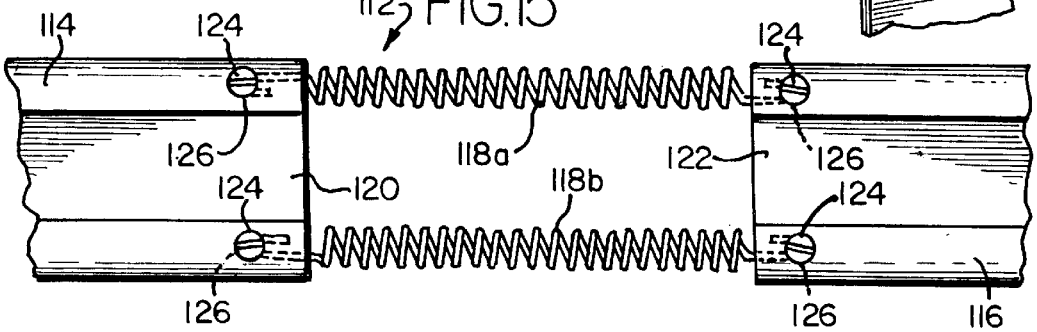
FIG. 15 is a side view of another embodiment of the hinged drapery rod in accordance with the invention.
Figure 16:
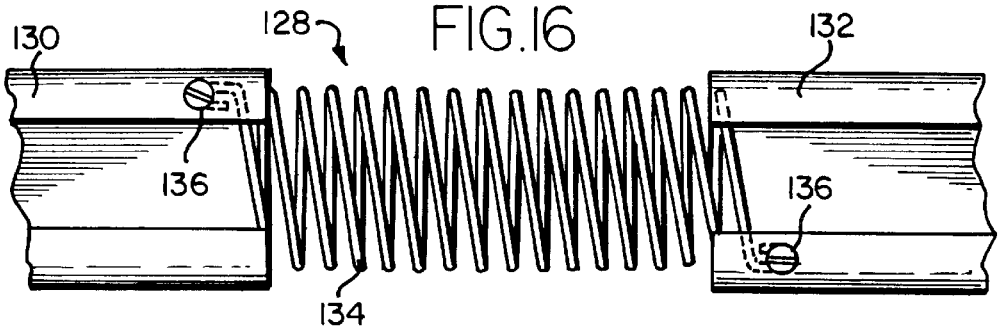
FIG. 16 is a side view of another embodiment of the hinged drapery rod in accordance with the invention.

Another embodiment is illustrated in FIG. 15 wherein drapery rod assembly 112 comprises first and second elongated rods 114 and 116 and coil springs 118*a* and 118*b*. Rods 114 and 116 have respective end portions 120 and 122. Coil springs 118*a* and 118*b* span the distance between rods 114 and 116 and attach to rods 114 and 116 at end portions 120 and 122. Preferably, springs 118*a* and 118*b* are attached to end portions 120 and 122 by screws 124 as shown in FIG. 15. This allows for easy replacement of springs 118*a* and 118*b*. Springs 118*a* and 118*b* may also be attached to rods 114 and 116 as previously described or by any means known to those skilled in the art. For example, screws 124 maybe removed from openings 126 and springs 118*a* and 118*b* may simply be hooked into openings 126. The number and/or arrangement of springs may be as desired and can be in a parallel or criss-cross relation, for example. Likewise, a single coil spring 134 which may have substantially the same width as first and second elongated rods 130 and 132 of drapery rod assembly 128 may be attached to rods 130 and 132 by screws 136 as previously described and shown in FIG. 16. Springs 118*a*, 118*b* and 134 may be made of any suitable resilient material including, but not limited to, plastic or metal, for example.

Figure 17:
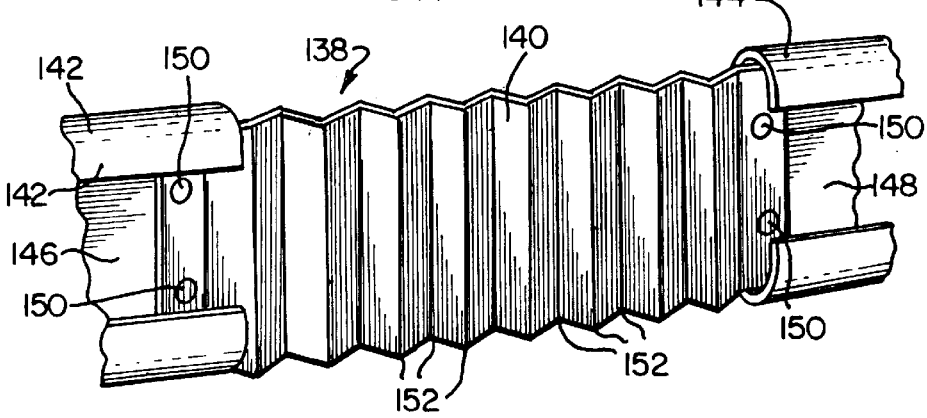
FIG. 17 is a side view of another embodiment of the hinged drapery rod in accordance with the invention.

FIG. 17 depicts drapery rod assembly 138 comprising a pleated bridging member 140 and first and second elongated rods 142 and 144 having respective end portions 146 and 148. Rivets 150 attach pleated member 140 to end portions 146 and 148. Any other suitable fastening structure can be utilized. Pleats 152 are vertically disposed and are substantially parallel to each other as well as substantially parallel to the axis of rotation for the operating panel. In this configuration, pleats 152 enable pleated member 140 to bend and decrease in length when the operating panel is opened and extend and increase in length when the operating panel closes. Pleated bridging member 140 may be made of any suitable flexible and resilient material including, but not limited to, metal mesh or fabric, braided metal, plastic, rubber, or a textile product, such as cloth or a synthetic fabric.

The embodiments of FIGS. 14–17 could be used where the drapery is on the interior and the operating door or panel opens outwardly (to the exterior) in which case the bridging member lengthens as the operating door opens to the exterior.

While the invention has been described with respect to certain preferred embodiments, as will be appreciated by those skilled in the art, it is to be understood that the invention is capable of numerous changes, modifications and rearrangements and such changes, modifications and rearrangements are intended to be covered by the following claims.

What is claimed is:

1. A drapery rod suitable for extending across and for spanning at least portions of first and second adjacent panels where one panel is stationary and the other panel is an operating panel and a hinge between the panels for opening the operating panel, comprising:

a first elongated rod attached to and spanning at least a portion of said first panel;

a second elongated rod extending in a direction opposed to said first rod, said second rod attached to and spanning at least a portion of said second panel;

a flexible, expandable bridging member that extends between the first and second elongated rods, said bridging member having first and second end portions, said first end portion attached to said first rod, said second end portion attached to said second rod.

2. The drapery rod according to claim 1 wherein said bridging member comprises a spring.

3. The drapery rod according to claim 2 wherein said spring is a coil spring.

4. The drapery rod according to claim 1 wherein said bridging member is an elastic resilient member.

5. The drapery rod according to claim 4 wherein said resilient member is a rubber strip.

6. The drapery rod according to claim 1 wherein said bridging member is a pleated member, said pleats remaining substantially parallel to the axis of rotation defined by said hinge throughout the entire range of motion of the operating panel.

7. The drapery rod according to claim 6 wherein said pleated member is selected from the group consisting of metal, plastic, rubber and fabric.

8. The drapery rod according to claim 1 wherein said bridging member moves in conjunction with the opening and closing of said operating panel.

9. The drapery rod according to claim 8 wherein said bridging member shortens when the operating panel is opened and lengthens when the operating panel closes.

10. A drapery assembly suitable for spanning at least portions of first and second adjacent panels where one panel is stationary and the other pane is an operating panel and a hinge between the panels for inwardly opening the operating panel, comprising:

a first elongated rod attached to and spanning at least a portion of said first panel;

a second elongated rod extending in a direction opposed to said first rod, said second rod attached to and spanning at least a portion of said second panel;

a flexible, expandable bridging member having first and second ends, said first end attached to said first rod, said second end attached to said second rod;

a continuous drapery of sufficient length to extend the entire length of the bridging member and at least a portion of the first and second rods.

11. The drapery assembly according to claim 10 wherein said bridging member comprises a spring.

12. The drapery assembly according to claim 11 wherein said spring is a coil spring.

13. The drapery assembly according to claim 10 wherein said bridging member is an elastic resilient member.

14. The drapery assembly according to claim 13 wherein said resilient member is a rubber strip.

15. The drapery assembly according to claim 10 wherein said bridging member is a pleated member, said pleats remaining substantially parallel to the axis of rotation defined by said hinge throughout the entire range of motion of the operating panel.

16. The drapery assembly according to claim 15 wherein said pleated member is selected from the group consisting of metal, plastic, rubber and fabric.

17. The drapery assembly according to claim 10 wherein said bridging member moves in conjunction with the opening and closing of said operating panel.

18. The drapery assembly according to claim 10 wherein said bridging member shortens when the operating panel is opened and lengthens when the operating panel closes.

19. The drapery assembly according to claim 10 wherein said drapery spans across the bridging member and at least portions of said first and second rods while the operating panel opens and closes.

20. The drapery assembly according to claim 19 wherein said drapery shortens when the operating panel is opened and lengthens when the operating panel closes.

21. A method for making a drapery rod suitable for spanning at least portions of first and second door panels wherein one door panel is stationary and the other door panel is a hinged opening operating door panel, comprising:

providing a flexible expandable bridging member, a first elongated, length-variable rod assembly, and a second elongated rod;

attaching the first elongated rod assembly and the second elongated rod to the bridging member wherein the second elongated rod extends in an opposite direction from the first elongated rod assembly; and securing the first elongated rod assembly to the first door panel to extend along at least a portion of the first door panel and securing the second elongated rod to the second door panel to extend along at least a portion of the second door panel.

22. A method for spanning a continuous drapery across at least portions of first and second door panels wherein one door panel is stationary and the other door panel is a hinged opening operating door panel, comprising:

providing a flexible expandable bridging member, a first elongated, length-variable rod assembly, and a second elongated rod;

attaching the first elongated rod assembly and the second elongated rod to the bridging member wherein the second elongated rod extends in an opposite direction from the first elongated rod assembly;

securing the first elongated rod assembly to the first door panel to extend along at least a portion of the first door panel and securing the second elongated rod to the second door panel to extend along at least a portion of the second door panel;

providing a length of drapery suitably adapted to continuously cover the hinge, the first elongated assembly, and the second elongated rod throughout the entire range of motion of the openable door panel.

* * * * *